United States Patent [19]

Zumbuhl

[11] Patent Number: 4,905,852

[45] Date of Patent: Mar. 6, 1990

[54] PLASTIC CLOSURE WITH IMPROVED SEAL

[75] Inventor: Bruno Zumbuhl, Conyngham, Pa.

[73] Assignee: Zapata Industries, Inc., Frackville, Pa.

[21] Appl. No.: 357,725

[22] Filed: May 26, 1989

[51] Int. Cl.[4] ..... B65D 53/00

[52] U.S. Cl. ..... 215/270; 215/344; 215/DIG. 1

[58] Field of Search ..... 215/270, 344, DIG. 1, 215/329

[56] References Cited

U.S. PATENT DOCUMENTS

| | | | |
|---|---|---|---|
| 3,053,406 | 9/1962 | Wandell | 215/40 |
| 3,180,534 | 4/1965 | Duda et al. | 222/321 |
| 3,203,571 | 8/1965 | Plunkett | 215/40 |
| 3,203,572 | 8/1965 | Scott, Jr. et al. | 215/56 |
| 3,232,470 | 2/1966 | Gibson | 215/43 |
| 3,339,773 | 9/1967 | Stull | 215/40 |
| 3,360,149 | 12/1967 | Roth | 215/40 |
| 3,463,340 | 8/1969 | Lindstrom | 215/40 |
| 3,482,725 | 12/1969 | Exton | 215/43 |
| 3,784,041 | 1/1974 | Birch | 215/40 |
| 3,815,771 | 6/1974 | Marks | 215/344 |
| 3,851,784 | 12/1974 | Gryncewicz | 215/40 |
| 3,854,618 | 12/1974 | Beghnini | 215/307 |
| 3,948,405 | 4/1976 | Yonker | 215/344 |
| 4,061,240 | 12/1977 | Brownbill | 215/270 |
| 4,089,463 | 5/1978 | Babiol | 215/329 |
| 4,143,785 | 3/1979 | Ferrell | 215/270 |
| 4,220,250 | 9/1980 | Brownbill | 215/270 |
| 4,269,320 | 5/1981 | Birog, Jr. et al. | 215/252 |
| 4,276,989 | 7/1981 | Hicks | 215/270 |
| 4,392,579 | 7/1983 | Uhlig et al. | 215/253 |
| 4,416,383 | 11/1983 | Frahm et al. | 215/256 |
| 4,429,802 | 2/1984 | Marks | 215/344 |
| 4,442,947 | 4/1984 | Banich, Sr. | 215/344 |
| 4,461,392 | 7/1984 | Conti | 215/270 |
| 4,598,835 | 7/1986 | Brownbill | 215/307 |
| 4,645,088 | 2/1987 | Menichetti | 215/329 |

FOREIGN PATENT DOCUMENTS

| | | |
|---|---|---|
| 667287 | 9/1964 | Italy . |
| 564461 | 7/1975 | Switzerland . |
| 607702 | 10/1978 | Switzerland . |
| 925647 | 5/1963 | United Kingdom . |
| 960443 | 6/1964 | United Kingdom . |

*Primary Examiner*—Donald F. Norton

*Attorney, Agent, or Firm*—Shapiro and Shapiro

[57] ABSTRACT

A plastic closure for a container, such as a bottle having an externally threaded neck, has a top wall, an internally threaded sidewall, and a seal comprising outer and inner concentric sealing members that extend downwardly from an inner surface of the top wall. The outer sealing member extends downwardly farther than the inner sealing member and is substantially thicker than the inner sealing member. The outer sealing member is disposed to engage an outer corner of the rim of the neck of the bottle when the closure is threaded onto the bottle, and the inner sealing member is disposed to engage the top of the rim after engagement of the corner with the outer sealing member. The outer sealing member deflects outward slightly, and the inner sealing member deflects upwardly and inwardly. Movement of the top wall of the closure toward the rim is limited by a shoulder between the sealing members, so that when the closure is fully threaded onto the bottle, the inner sealing member is spaced from the inner surface of the top wall of the closure.

8 Claims, 2 Drawing Sheets

PLASTIC CLOSURE WITH IMPROVED SEAL

BACKGROUND OF THE INVENTION

This invention relates to plastic closures for bottles and the like and is more particularly concerned with a threaded plastic cap having an improved integral seal.

The prior art is replete with threaded plastic closures for bottles and the like, including closures having a wide variety of seals. Such seals may include a plurality of annular members that engage one or more of the surfaces constituting the rim of the neck of the bottle. For example, U.S. Pat. No. 4,143,785 discloses a plastic vacuum sealing cap with inner and outer annular flanges extending downwardly from the inner surface of the top wall of the cap, the inner flange extending inwardly at an angle of about 45° to the top wall and being somewhat longer than the outer flange, that extends outwardly at an angle of about 80° to the top wall. U.S. Pat. No, 4,461,392 discloses a threaded plastic bottle cap that includes a similar arrangement of sealing flanges, but in which the cap is provided with an annular groove in the inner surface of the top wall for reception of the inner flange when the cap is fully threaded onto the bottle neck. U.S. Pat. No. 4,645,088 discloses a plastic closure for bottles in which inner and outer annular sealing flanges extend downwardly from a top wall having a concave inner surface. The outer flange has an annular groove that mates with the rim of the neck of a bottle.

BRIEF DESCRIPTION OF THE INVENTION

The present invention provides an improved seal in a threaded plastic closure for bottles and the like. The seal of the invention, like seals of the prior art, comprises a pair of concentric sealing members. However, in accordance with the invention the sealing members have a special configuration and relationship for providing improved sealing.

More particularly, the present invention provides a plastic closure for a bottle having an externally threaded neck, the closure having a top wall, an internally threaded sidewall, and a seal. The seal comprises outer and inner concentric sealing members that extend downwardly from an inner surface of the top wall. The outer sealing member extends downwardly farther than the inner sealing member and is substantially thicker than the inner sealing member. The outer sealing member has an outer side surface that extends downwardly and inwardly and has an inner side surface that extends downwardly and outwardly. The inner sealing member has outer and inner side surfaces that extend downwardly and inwardly. The inner side surface of the outer sealing member is disposed to engage an outer corner of the rim of the neck of the bottle when the closure is threaded onto the bottle, and the inner sealing member is disposed to engage the top of the rim after engagement of the corner with the inner surface of the outer sealing member. The outer sealing member is adapted to deflect outward slightly due to the engagement of its inner side surface with the corner of the rim, and is substantially more rigid than the inner sealing member. The inner sealing member is adapted to deflect upwardly and inwardly to form a top seal on the rim. Movement of the top wall of the closure toward the rim is limited so that when the closure is fully threaded onto the bottle, a space remains between the inner surface of the inner sealing member and the inner surface of the top wall of the closure.

BRIEF DESCRIPTION OF THE DRAWING

The invention will be further described in conjunction with the accompanying drawings, which illustrate a preferred (best mode) embodiment, and in which.

DETAILED DESCRIPTION OF PREFERRED EMBODIMENT

Figure 1:
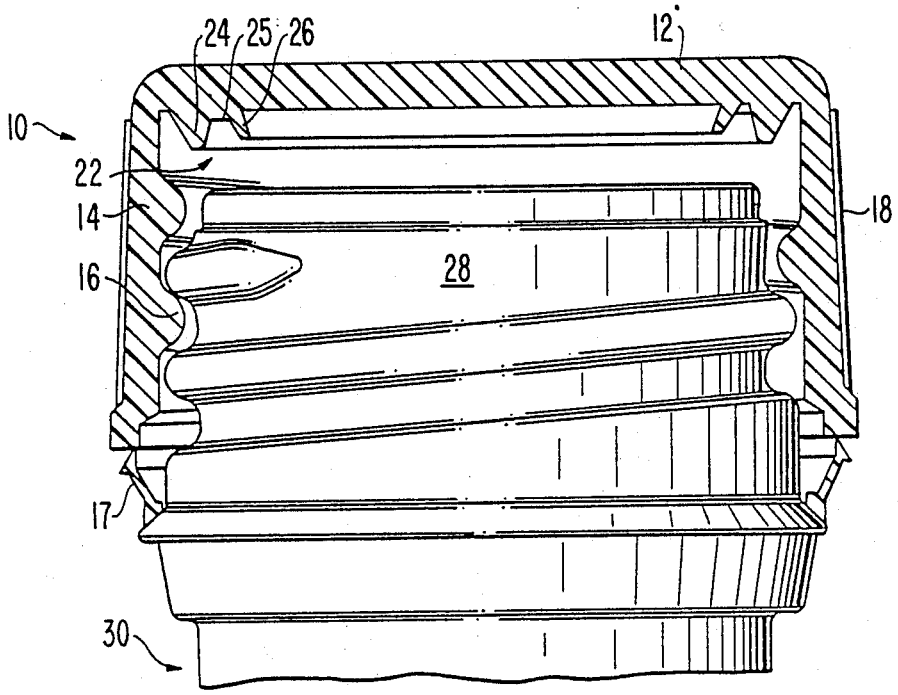
FIG. 1 is a vertical sectional view showing a closure in accordance with the invention being applied to the neck of a container.

As shown in FIG. 1, a plastic closure 10 in accordance with the invention, which may be molded as a single piece of polypropylene or polyethylene, for example, by conventional molding apparatus, comprises a top wall 12 and a sidewall 14 having internal threads 16. The bottom portion of the closure may be constituted by a tamper-resistant ring 17 when this feature is desired. The outer surface of the sidewall may have a series of longitudinal ribs 18 to provide additional friction when the closure is grasped.

Figure 3:
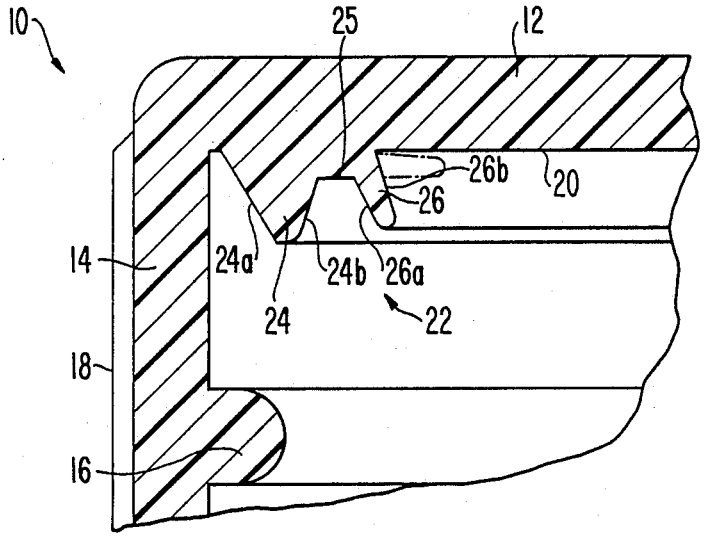
FIG. 3 is a fragmentary vertical sectional view of the closure prior to its application to the container.

As shown in greater detail in FIG. 3, a seal 22 extends downwardly from the flat inner surface 20 of the top wall, preferably integral therewith, and comprises a pair of concentric annular sealing members 24, 26. The outer sealing member 24 of the pair is substantially thicker in cross-section than the inner sealing member 26 and extends downwardly beyond the inner sealing member as shown. The outer side surface **24*a* of the outer sealing member extends straight downwardly and inwardly at an angle of about 30° to the axis of the closure and to the inner surface of the sidewall (vertical in the drawings), while the inner side surface 24*b* of the outer sealing member extends straight downwardly and outwardly at an angle of about 5° to the axis, but this angle will vary depending upon the tolerance of the bottle finish to be accommodated. An annular shoulder 25** between the sealing members is substantially parallel to the inner surface of the top wall.

The outer side surface **26*a* of the inner sealing member extends straight downwardly and inwardly substantially parallel to the corresponding surface of the outer sealing member. The inner side surface 26*b*** of the inner sealing member also extends straight downwardly and inwardly but forms a smaller angle relative to the axis so that the side surfaces of the inner sealing member converge toward the lower extremity of the inner sealing member, which is slightly convex. The lower extremity of the outer sealing member is essentially flat, but with a small convex curvature at the junction with the inner side surface of the outer sealing member. By virtue of its configuration, the outer sealing member is substantially more rigid than the inner sealing member.

Figure 2:
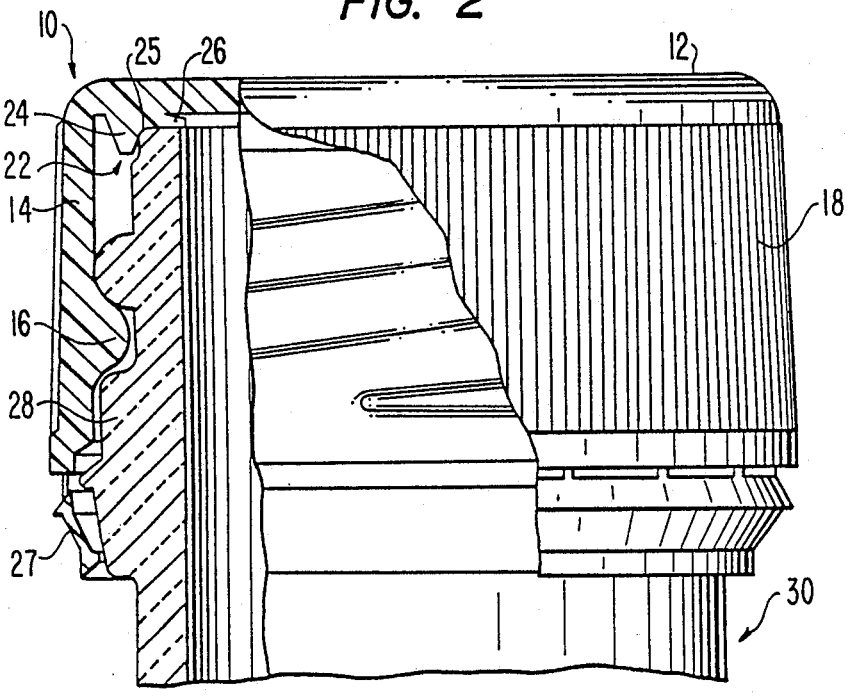
FIG. 2 is an elevational view, partly broken away and in section, showing the closure after it has been applied to the container.

As shown in FIG. 1, the outer sealing member is disposed to engage the outer corner of the rim 28 of the neck of a container such as a bottle 30 prior to engagement of the inner sealing member with the top of the rim as the closure is threaded onto the neck, so that the outer sealing member serves to center the closure relative to the neck of the bottle. During continued application of the closure to the bottle, the rim of the neck slides upward along the inner side surface of the outer sealing member, causing the outer sealing member to deflect outward slightly, but because of the rigidity of the outer sealing member, the centering action of the outer sealing member is maintained. The top surface of the rim then engages the lower end of the inner sealing member, causing the inner sealing member to deflect inwardly and upwardly as shown in FIG. 2. Accordingly, an outer side seal and a top seal are formed when the closure is threaded onto the bottle.

If the inner diameter of the neck of the bottle is larger than shown in FIG. 2, so that the thickness of the neck is reduced, the inner sealing member may engage the inner corner of the rim in addition to the top of the rim. In either case, the approach of the top wall of the closure to the top of the rim is limited by shoulder 25, so that the outer corner of the rim remains engaged with the inner side surface **24*b* of the outer sealing member 24** and so that the inner sealing member is never deflected upwardly so far as to cause the inner side surface thereof to become juxtaposed with the inner surface of the top wall of the closure. Therefore, despite the absence of a groove in the interior surface of the top wall of the closure, a space remains between the inner side surface of the inner sealing member and the opposed inner surface of the top wall (as indicated by the phantom line showing in FIG. 3), so that if the bottle is pressurized, the pressure will be applied to the inner sealing member to force the inner sealing member more tightly into engagement with the top of the rim.

From the foregoing description, it is apparent that the invention provides a plastic closure with a seal that is quite effective and yet is quite simple in construction. The seal of the invention does not require a special closure configuration, such as a closure with a curved top wall, and does not require an outer sealing ring having a concave inner surface designed to fit the outer corner of the rim of the neck of a bottle. The invention is sufficiently versatile to accommodate a diversity of bottle finishes.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. A plastic closure for a bottle and the like having an externally threaded neck, said closure having a top wall, an internally threaded sidewall, and a seal, said seal comprising outer and inner concentric sealing members extending downwardly from an inner surface of said top wall, said outer sealing member extending downwardly farther than said inner sealing member and being substantially thicker than said inner sealing member, said outer sealing member having an outer side surface that extends downwardly and inwardly and having an inner side surface that extends downwardly and outwardly, said inner sealing member having outer and inner side surfaces that extend downwardly and inwardly, said inner side surface of said outer sealing member being disposed to engage an outer corner of the rim of the neck of the bottle when the closure is threaded onto the bottle, and said inner sealing member being disposed to engage the top of the rim after engagement of said corner with said inner surface of said outer sealing member, said outer sealing member being adapted to deflect outward slightly due to the engagement of its inner side surface with said corner of the rim and being substantially more rigid than said inner sealing member, said inner sealing member being adapted to deflect upwardly and inwardly to form a top seal on said rim, movement of said top wall of said closure toward said rim being limited so that when said closure is fully threaded onto said bottle, the inner surface of the inner sealing member is spaced from the inner surface of the top wall of the closure.

2. A closure in accordance with claim 1, wherein movement of said top wall of said closure toward said rim is limited by a shoulder between said sealing members.

3. A closure in accordance with claim 1, wherein said outer side surface of said outer sealing member forms an angle of about 30° relative to the axis of the closure.

4. A closure in accordance with claim 3, wherein said outer side surface of said inner sealing member is substantially parallel to said outer side surface of said outer sealing member, and said inner side surface of said inner sealing member forms a small angle with said outer side surface of said inner sealing member, so that the inner and outer side surfaces of said inner sealing member converge toward a lower extremity of said inner sealing member.

5. In combination with a container having an externally threaded neck, a plastic closure having a top wall, an internally threaded sidewall, and a seal, said seal comprising outer and inner concentric sealing members extending downwardly from an inner surface of said top wall, said outer sealing member extending downwardly farther than said inner sealing member and being substantially thicker than said inner sealing member, said outer sealing member having an outer side surface that extends downwardly and inwardly and having an inner side surface that extends downwardly and outwardly, said inner sealing member having outer and inner side surfaces that extend downwardly and inwardly, said inner side surface of said outer sealing member engaging an outer corner of the rim of the neck of the container, and said inner sealing member engaging the top of the rim, said outer sealing member being deflected outward slightly due to the engagement of its inner side surface with said corner of the rim and being substantially more rigid than said inner sealing member, said inner sealing member being deflected upwardly and inwardly to form a top seal on said rim, the inner surface of the inner sealing member being spaced from the inner surface of the top wall of the closure.

6. A combination in accordance with claim 5, wherein the top of said rim engages a shoulder between said sealing members which limits the movement of said closure toward said rim and ensures that the inner surface of the inner sealing member is spaced from the inner surface of the top wall of the closure.

7. A combination in accordance with claim 5, wherein said outer side surface of said outer sealing member forms an angle of about 30° relative to the axis of the closure.

8. A combination in accordance with claim 7, wherein said outer side surface of said inner sealing member is substantially parallel to said outer side surface of said outer sealing member, and said inner side surface of said inner sealing member forms a small angle with said outer side surface of said inner sealing member, so that the inner and outer side surfaces of said inner sealing member converge toward a lower extremity of said inner sealing member.

* * * * *